US009127430B2

(12) United States Patent
Mitchell

(10) Patent No.: US 9,127,430 B2
(45) Date of Patent: Sep. 8, 2015

(54) METHOD AND APPARATUS FOR RAISING MANHOLE CASTINGS

(76) Inventor: Andrew C. Mitchell, Rockford, MI (US)

( * ) Notice: Subject to any disclaimer, the term of this patent is extended or adjusted under 35 U.S.C. 154(b) by 482 days.

(21) Appl. No.: 12/686,077

(22) Filed: Jan. 12, 2010

(65) Prior Publication Data

US 2010/0178106 A1 Jul. 15, 2010

Related U.S. Application Data

(60) Provisional application No. 61/144,293, filed on Jan. 13, 2009.

(51) Int. Cl.
*E02D 29/14* (2006.01)

(52) U.S. Cl.
CPC ..... *E02D 29/1409* (2013.01); *E02D 29/1445* (2013.01)

(58) Field of Classification Search
CPC ..... E02D 29/1409; E02D 29/1445
USPC ..... 404/25, 26; 249/1; 52/742.14, 405.3
See application file for complete search history.

(56) References Cited

U.S. PATENT DOCUMENTS 3,390,224 A * 6/1968 Wyatt ..... 174/37
3,533,199 A * 10/1970 Pickett ..... 52/20
3,847,339 A * 11/1974 Farrell ..... 249/1
4,337,005 A * 6/1982 LeBaron ..... 404/26
5,095,667 A * 3/1992 Ryan et al. ..... 52/20
5,492,656 A * 2/1996 Tracy ..... 264/32
5,634,739 A * 6/1997 Armstrong ..... 404/26
6,161,985 A * 12/2000 Hinkle et al. ..... 404/26
6,692,183 B2 * 2/2004 Godfrey ..... 404/26
6,851,225 B1 * 2/2005 Haar et al. ..... 52/20
6,869,249 B2 * 3/2005 Calhoon ..... 404/26
7,537,413 B1 * 5/2009 Brugos ..... 404/25
2008/0044225 A1 * 2/2008 Swartz ..... 404/25

* cited by examiner

*Primary Examiner* — Abigail A Risic
(74) *Attorney, Agent, or Firm* — Mitchell Intellectual Property Law, PLLC

(57) ABSTRACT

The specification discloses apparatus and a process in which the stack of concrete or hard rubber spacer rings used in raising manholes is eliminated. It is replaced with a sleeve which is taller than the required distance between the top of the manhole and the level at which the casting and manhole cover are to be finally located, but which is sufficiently flexible in a vertical direction that when a casting is located in the top of the sleeve, the sleeve compresses downwardly. The height of the casting is fixed by a casting support resting on the pavement base coat or other base surface to which the final pavement will be applied around the casting. The sleeve is sufficiently stiff in a lateral direction that it does not collapse inwardly when backfill is packed in and around the exterior of the sleeve. The casting support is removed and the final layer of pavement is applied over the base surface.

18 Claims, 9 Drawing Sheets

METHOD AND APPARATUS FOR RAISING MANHOLE CASTINGS

CROSS REFERENCE TO RELATED APPLICATIONS

This application claims priority from U.S. patent application Ser. No. 61/144,293, filed Jan. 13, 2009.

FIELD OF THE INVENTION

The present invention relates to the field of "raising manhole castings." When a manhole 10 is placed in or alongside of a road bed, a steel plate 20 is placed over the upper opening 11 of the manhole (FIG. 1). The manhole is then covered with gravel mix 15 to the level of the roadbed, and a base coat layer of pavement 16 is applied over the road bed, providing a base surface to which the final pavement layer will be applied around the manhole casting in its final position. Usually, only a so-called base coat layer of pavement is applied, leaving the final layer of pavement to be applied at a later time.

The buried steel plate is then located, usually using a metal detector. The applied pavement 16 over plate 20 is cut away to form an opening 17 in the pavement, and the gravel mix 15 over the steel plate 20 (over burden) is dug away to create a hole 18 exposing the steel plate 20 over the top of manhole 10 (FIGS. 1 and 2). (Item 12 in the FIG. 2 is a ladder rung on the inside of the manhole.) The steel plate 20 is removed from the manhole to expose the open top 11 of manhole 10 (FIG. 2).

The opening 11 is then "raised" to a level which will support a manhole casting 30 (FIGS. 3A and 3B) with its top 31 at the level of the final pavement layer, by placing several concrete or hard rubber rings 40 (FIGS. 4A and 4B) on the top ledge 13 of manhole 10, surrounding opening 11. The number of rings 40 used depends on the distance between the top of manhole 10 and the final level at which the casting and cover are to be located, i.e. the level of the final pavement layer. The stack of spacer rings 40 are cemented together using a cement appropriate to the concrete or rubber material of which rings 40 are made. Casting 30 includes an annular shoulder flange 32, which is then seated onto the top concrete or rubber ring 40 in the stack (FIG. 4B), and the manhole cover 35 is set in place over the casting opening. The hole 18 around the stack of spacer rings is then backfilled with concrete to the level of the bottom of the casting annular shoulder flange 32. The final layer of pavement is applied to the level of the top 31 of the casting 30.

SUMMARY OF THE INVENTION

In the present invention, the stack of concrete or hard rubber spacer rings is eliminated and replaced with a sleeve which is taller than the required distance between the top of the manhole and the level at which the casting and manhole cover are to be finally located, but which is sufficiently flexible in a vertical direction that when a casting is located in the top of the sleeve, the sleeve compresses downwardly. The height of the casting is fixed by a casting support resting on the pavement base coat or other base surface to which the final pavement will be applied around the casting. The sleeve is sufficiently stiff in a lateral direction that it does not collapse inwardly when the backfill is packed in and around the exterior of the sleeve. The casting support is removed and the final layer of pavement is applied over the base surface.

These and other features, objects and advantages of the invention will be more fully understood and appreciated by reference to the appended drawings and the description of the preferred embodiments.

DESCRIPTION OF THE PREFERRED EMBODIMENTS

Figure 1:
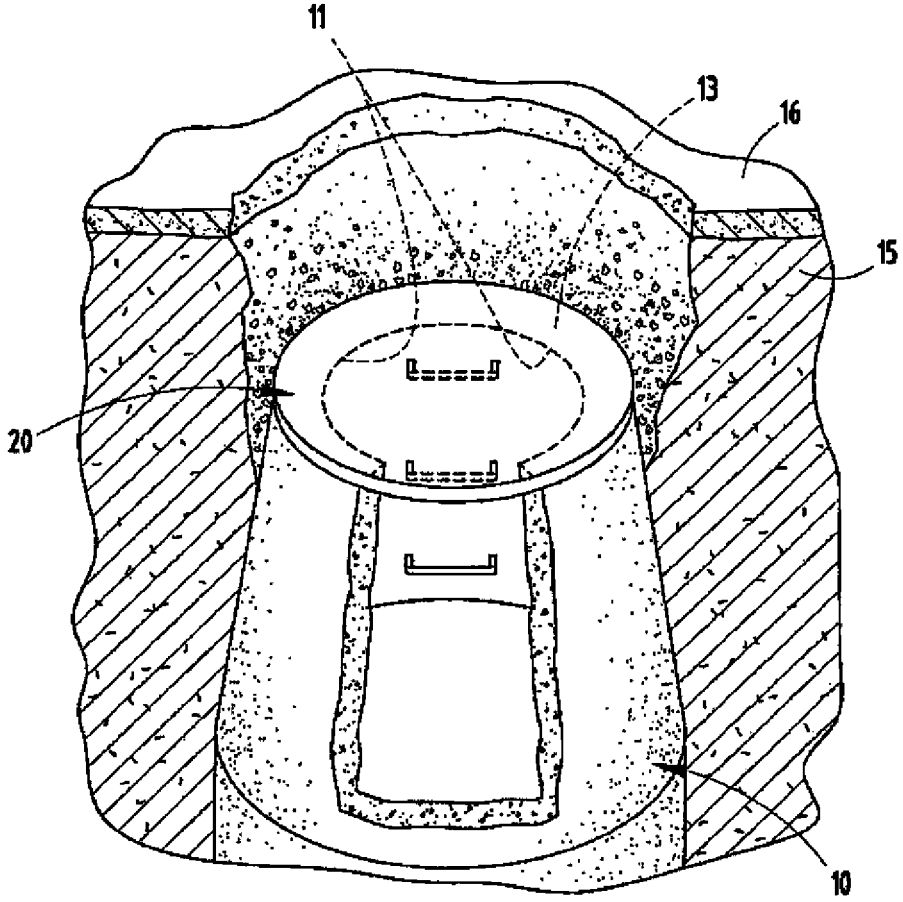
FIG. 1 (PRIOR ART)
FIG. 1 (prior art) is a partially cross-sectional, partially fragmentary view of an in the ground manhole covered by a steel plate.
Figure 2:
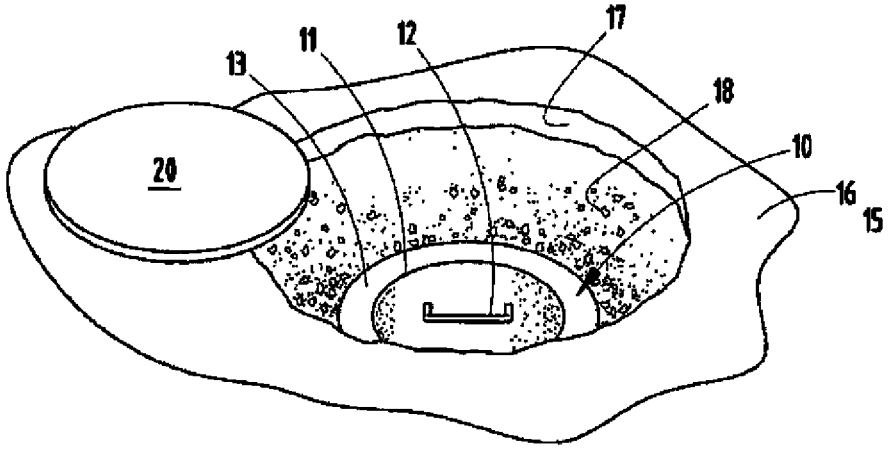
FIG. 2 (PRIOR ART)
FIG. 2 (prior art) is a perspective drawing looking into a hole which has been cut away in the pavement and dug out, exposing a covered manhole, with the steel covering plate removed.
Figure 3A:
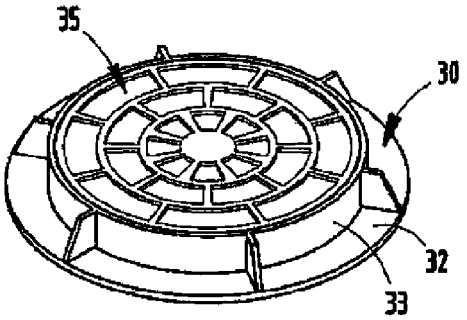
FIG. 3A (PRIOR ART)
FIG. 3A (prior art) is a perspective view of a manhole casting with a manhole cover in place.
Figure 3B:
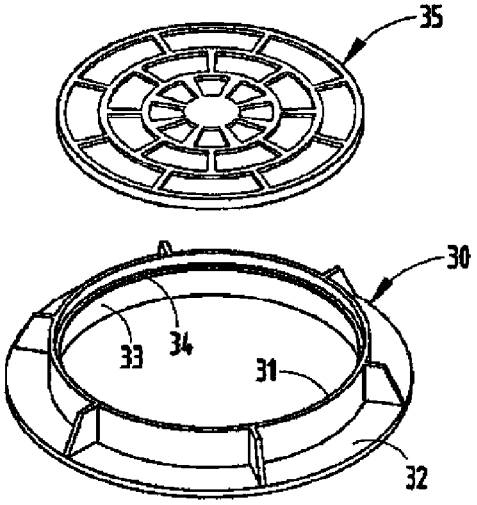
FIG. 3B (PRIOR ART)
FIG. 3B (prior art) is the same view with the manhole cover exploded away.
Figure 4A:
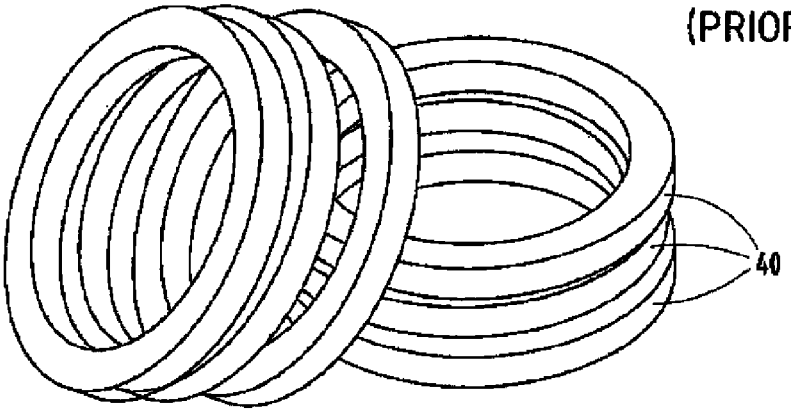
FIG. 4A (PRIOR ART)
FIG. 4A (prior art) is a perspective view of a stack of rings of the type typically used to "raise" the manhole casting.
Figure 4B:
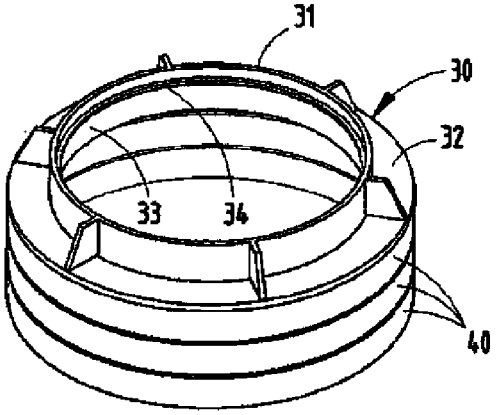
FIG. 4B (PRIOR ART)
FIG. 4B (prior art) shows a manhole casting seated atop a stack of raising rings.
Figure 5A:
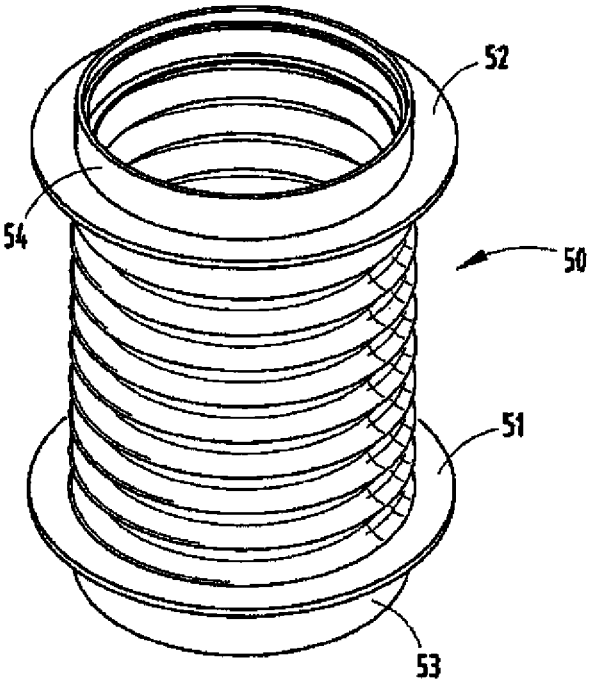
FIG. 5A is a perspective view of a casting raiser preferred embodiment sleeve in accordance with the present invention.
Figure 5B:
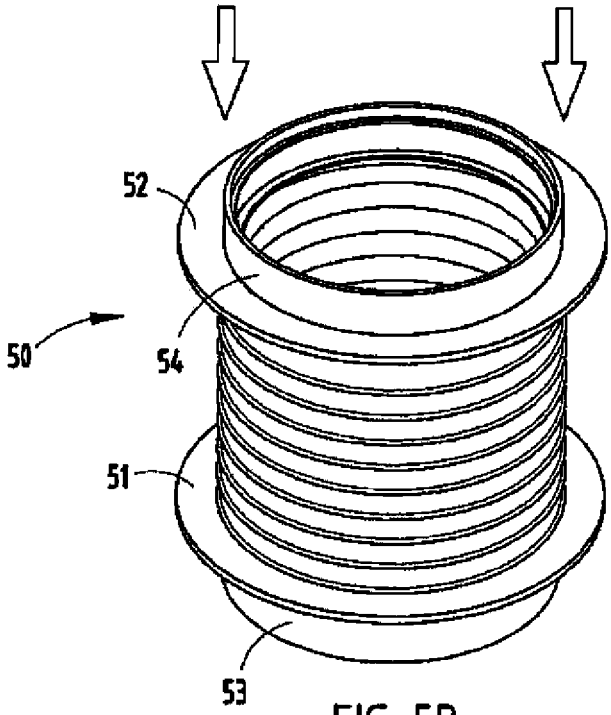
FIG. 5B is a perspective view of the sleeve compressed relative to the view shown in FIG. 5A.
Figure 8A:
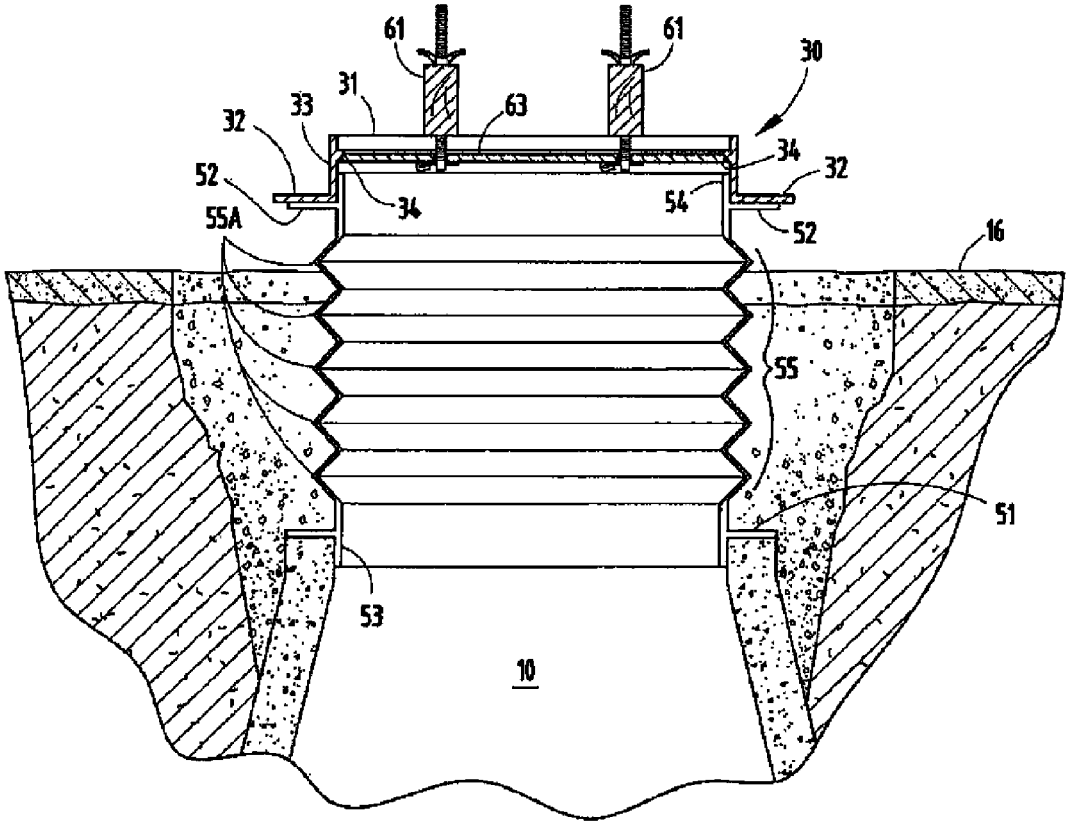
FIG. 8A is a cross-sectional view showing the casting ring being lowered over the top end of a sleeve with the sleeve still extended.

In the preferred embodiment, sleeve 50 includes a bottom annular flange 51 projecting outwardly from the sleeve a short distance up from the bottom end of the sleeve (FIGS. 5A and 5B). Similarly, a top annular flange 52 projects outwardly from the sleeve a short distance from the top of the sleeve. The bottom projection 53 of sleeve 50 is dimensioned to fit into the opening 11 in the top of the manhole 10 until the bottom annular flange 51 comes to rest against the top edge 13 of manhole 10 (FIG. 8A). Similarly, the top projection 54 of sleeve 50 is shaped to be inserted into casting 30 until the upper flange 52 engages the bottom of the casting flange 32 (FIG. 8A). In one preferred embodiment, sleeve 10 is rendered flexible in a vertical direction at least in part by making at least a portion of the length of the sleeve with a corrugated wall 55. The corrugations 55A allow sleeve 10 to be compressed in a vertical direction, or along the longitude of the sleeve, in accordion-like fashion (compare FIGS. 5A and 5B, as well as 8A and 8B). Corrugations 55A also allow sleeve 50 to flex differentially from side to side, thus accommodating minor differences in slope between the top 13 of manhole 10, and the pavement base layer. This usually occurs because the road is formed with a crown at the center and slopes away towards the sides.

Sleeve 50 can be made of any material which allows the sleeve to flex in a vertical direction (which might also be referred to as the longitudinal direction of sleeve 50) so that its height can be compressed when a casting is loaded onto the top of sleeve 50. This flexing can be achieved by the nature of the material of which the sleeve is made, or by the accordion action of corrugations 55A, or most typically by a combination of both. Preferably, sleeve 10 is made of a polymeric material.

Yet, the material of which sleeve 10 is made must be sufficiently stiff that when backfill is packed in and around the sleeve, it does not collapse inwardly. One of ordinary skill in the art will be able to select appropriate stiff rubber or other polymeric material of sufficient thickness to form sleeve 50 in such a way that it will both flex vertically and be sufficiently stiff that it will not collapse inwardly when backfill is packed in around it.

Figure 6A:
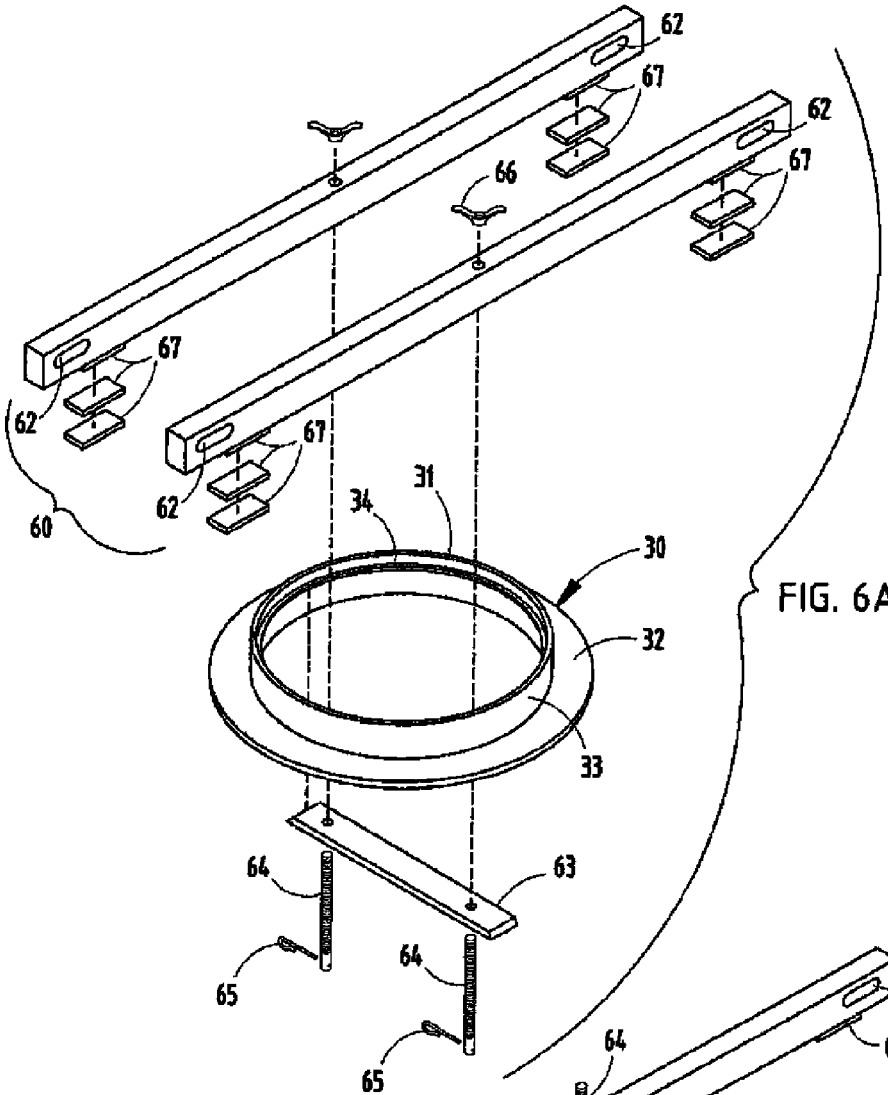
FIG. 6A shows an exploded view of a carrier and positioning assembly for carrying and positioning a casting ring atop the preferred embodiment sleeve of the present invention.
Figure 6B:
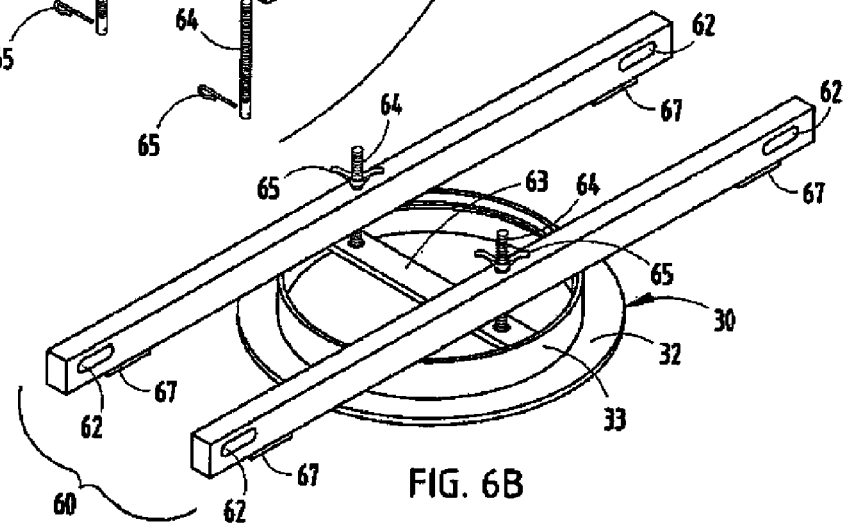
FIG. 6B is a perspective view of the assembled carrier and positioning assembly carrying a casting ring.
Figure 7A:
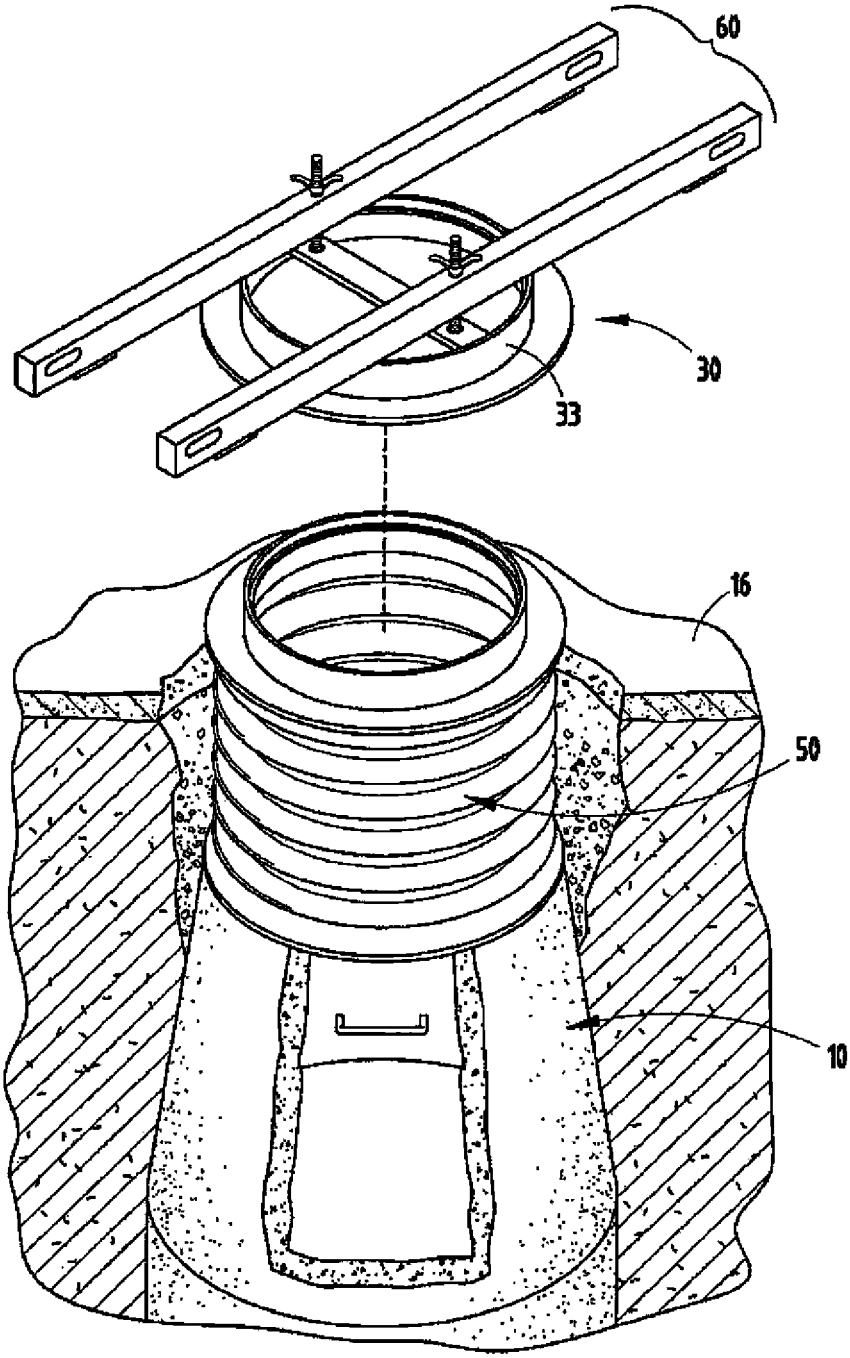
FIG. 7A is a perspective, partially cross-sectional and partially broken away view of a manhole with a preferred embodiment sleeve seated on top of the manhole, and a carried casting being lowered into position on top of the sleeve.

Once the opening 17 in pavement 16 has been cut away, hole 18 dug down to manhole 10, and plate 20 has been removed, sleeve 50 is inserted into the top of manhole 10 until its bottom flange 51 comes to rest on the top edge 13 of manhole 10 (FIGS. 7A and 8A). Positioning of casting 30 atop sleeve 50 is facilitated by a casting carrier and positioning assembly 60 (FIGS. 6A and 6B). Carrier and positioning assembly 60 comprises a pair of rails 61 which may be connected by cross rails, not shown in FIGS. 6A and 6B. A handle opening 62 or other similar handle is provided at the end of each rail 61. A casting 30 is carried and held in position by a carrier bar 63 which extends laterally with respect to, and suspended below, rails 61. Carrier bar 63 is suspended below rails 61 by means of threaded rods 64 which pass through openings located towards the opposite ends of carrier bar 63 and also through openings passing through rails 61 near the centers thereof. Threaded rods 64 include a bottom shoulder or a pin 65 which engage the bottom of carrier bar 63. Nuts such as wing nuts 66 thread onto threaded rods 64 on the top side of rails 61, thus both supporting carrier bar 63 and allowing one to adjust the position of carrier bar 63 relative to the position of rails 61. Nuts 66 are tightened until the top edge 31 of casting 30 is brought up against the bottom of rails 61.

Figure 7B:
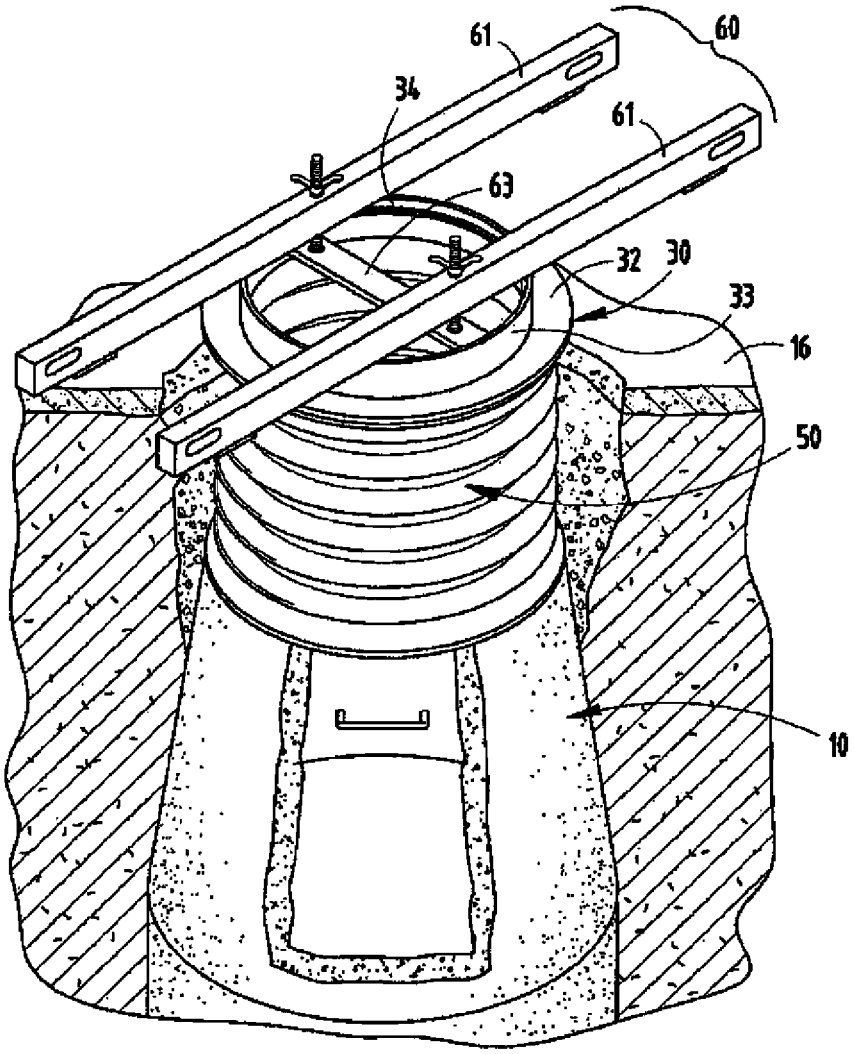
FIG. 7B is the same view as FIG. 7A, with the casting actually having been lowered into contact with the preferred embodiment sleeve.
Figure 8B:
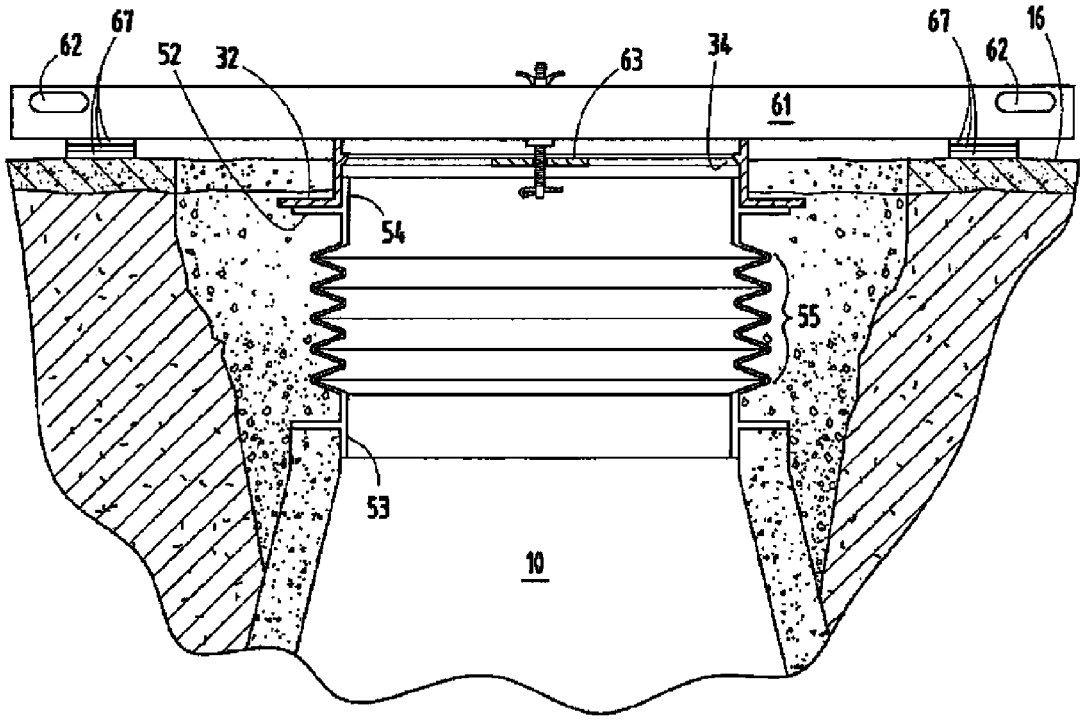
FIG. 8B is a cross-sectional view showing a carried casting ring having been lowered onto a sleeve of the preferred embodiment until the carrier assembly is seated on the pavement base layer.

A typical casting 30 is formed with an inner annular lip 34 on the inside of the annular vertical wall portion 33 of casting 30 (FIGS. 3B and 8A-C). Carrier bar 63 is shaped such that it will pass into the interior of vertical wall 33 at each end of carrier bar 63, but will engage and will not pass beyond annular lip 34. In this way, casting 30 can be lifted, carried and positioned by workers grasping the hand holes 62 of rails 60 and lifting. Casting 30 can then be positioned over a sleeve 50 which has been seated atop a manhole 10 (FIG. 7A), and can be lowered into position over the upper projecting end 54 of sleeve 50 (see FIGS. 7B and 8A). Rails 61 are then lowered until they engage the pavement base layer 16 (FIG. 8B).

Figure 8C:
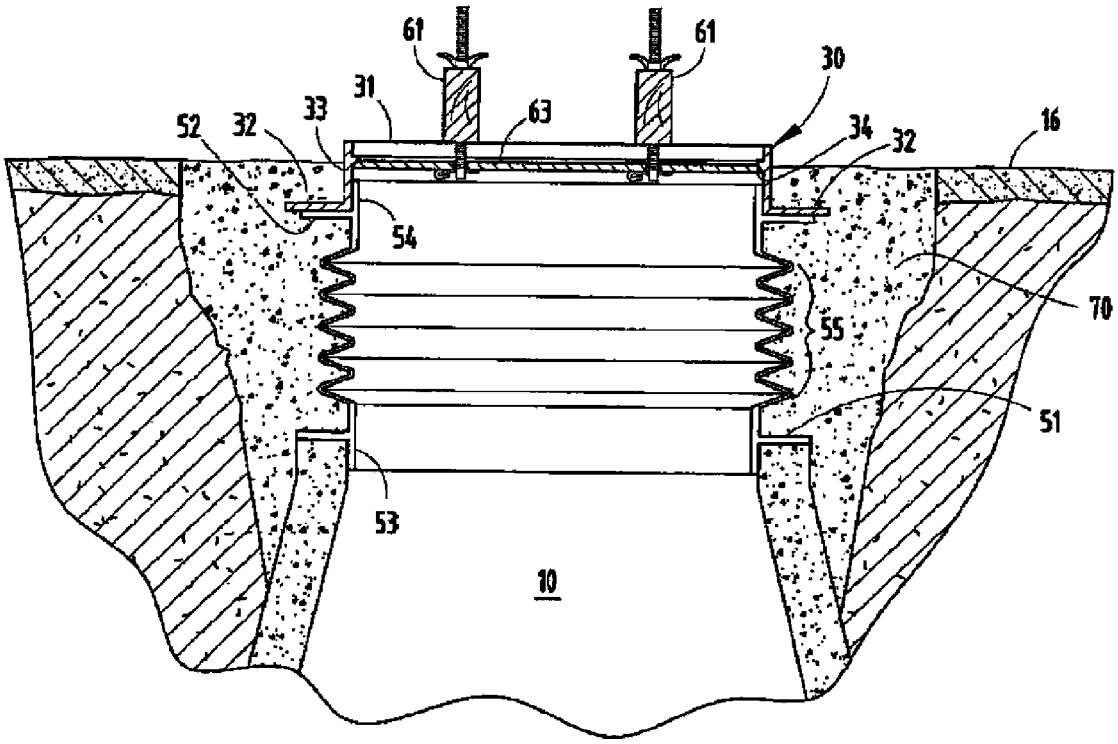
FIG. 8C is the view of FIG. 8B, rotated 90°, with the hole around the casting and sleeve filled in with concrete to the level of the pavement base layer.

Preferably, rails 61 are made of ferromagnetic material, or have ferromagnetic material located on the bottom of their end portions, such that one or several spacer magnets can be located at each end of rail 61 (FIGS. 6A and 8B). Sufficient spacer magnets 67 are employed to equal the approximate thickness of the final pavement layer (FIG. 8B). Other types of spacers could be employed to accommodate this function, but at the present time, magnetic spacers 67 are preferred. Spacers 67 position the top 31 of casting 30 at precisely the top level of the final layer of asphalt pavement (FIG. 8B). As can be seen in FIGS. 8B and 8C, when rails 61 are seated on pavement base layer 16, the top edge 31 of casting 30 is positioned above the level of pavement base coat 16, to accommodate the anticipated thickness of the final pavement layer.

In operation, sleeve 50 is placed in opening 11 at the top of manhole 10 until its annular flange 51 seats on the upper edge 13 of manhole 10 (FIGS. 7A and 8A). Carrier assembly 60 is used to lift casting 30 and place it in position over the upper portion 54 of sleeve 50 (FIG. 7A). Carrier rails 61 are then lowered over the upper portion 54 of sleeve 50, and the weight of casting 30 seated on sleeve flange 52 compresses sleeve 50 downwardly as seen by comparing FIGS. 8A and 8B. Casting 30 is lowered until spacers 67 on the bottom of rails 61 come to rest on pavement base layer 16 (FIG. 8B). Casting 30 is thus properly positioned for subsequent operations. The hole 18 around sleeve 50 is backfilled, preferably with concrete 70, to the level of the top of pavement base layer 16. Once the concrete has hardened, carrier assembly 60 is removed from casting 30 and the final layer of pavement is applied over pavement base layer and around the exposed upper portion of casting vertical wall 33.

It is understood that the foregoing is a description of preferred embodiments, and that various changes and alterations can be made without departing from the spirit and broader aspects of the invention.

The invention claimed is:

1. A method for raising manhole castings comprising: providing a hole in the pavement base surface to which pavement is to be applied around a manhole casting, said hole extending down to the top opening in the manhole; providing a flexible corrupted sleeve which is taller than the required distance between the top opening in the manhole and the level at which the casting and manhole cover are to be finally located, but which is sufficiently flexible in a vertical direction that when a casting is located in the top of the sleeve, the sleeve compresses downwardly, and which is sufficiently stiff in a lateral direction that it does not collapse inwardly when backfill is packed in and around the exterior of the sleeve; said sleeve including a bottom annular flange projecting outwardly from the sleeve a short distance up from the bottom end of the sleeve defining a bottom projection which projects below said bottom annular flange: and a top annular flange projecting outwardly from the sleeve a short distance from the top of the sleeve, defining a top projection which projects above said top annular flange: said bottom projection being dimensioned to fit into said top opening in said top of said manhole and said top projection being shaped to be inserted into said casting; providing a casting support which spans said hole for the manhole casting and rests on the pavement base surface; positioning said sleeve over the top opening in a manhole by inserting said bottom projection into said top opening until said bottom annular flange comes to rest against the top of said manhole around said opening; positioning a casting on the casting support; manipulating the casting support to lower the casting onto the top of the sleeve by lowering said casting over said top projection such that said top projection extends up into the opening in said casting, until said upper flange engages the bottom of the casting and continuing to lower the casting to compress the sleeve downwardly until the casting support rests on said pavement base surface; backfilling the hole around said sleeve and casting to about the level of the pavement base surface; then removing, the casting support and leaving the casting fixed in its final position by said back fill.

2. The method of claim 1, in which said sleeve is made of a polymeric Material.

3. The method of claim 2 in which said casting support comprises a pair of spaced rails and a carrier for said casting which is suspended below said rails; said step of positioning said casting on said casting support comprising positioning said casting on said carrier.

4. The method of claim 3 in which said carrier is adjustably suspended below said rails, allowing one to adjust the position of said carrier relative to the position of said rails, and wherein said carrier is adjusted to position said casting at its proper final level when said rails are supported by said pavement base layer.

5. The method of claim 4 in which the casting used is formed with an inner annular lip on the inside of the annular vertical wall surrounding the casting opening; said carrier being shaped such that it will pass upwardly into the opening defined by said vertical wall, but will engage and will not pass beyond annular lip, whereby said casting is supported by said carrier when said casting support is manipulated.

6. The method of claim 4 in which spacers are provided for positioning between the end portions of said rails and said pavement base surface, and which spacers are selected and positioned as necessary to position said casting at its proper final level when said rails are supported by said pavement base layer.

7. The method of claim 6 in which said rails are made of ferromagnetic material, or have ferromagnetic material located on the bottom of their end portions; said spacers being magnetic whereby they are readily positionable on and removable from said rails.

8. The method of claim 7 in which sufficient magnetic spacers are employed to equal the approximate thickness of the final pavement layer.

9. The method of claim 3 in which spacers are provided for positioning between the end portions of said rails and said pavement base surface, and which spacers are selected and positioned as necessary to position said casting at its proper final level when said rails are supported by said pavement base layer.

10. The method of claim 3 in which said rails have handles at their ends to facilitate manipulation.

11. The method of claim 1 in which said casting support comprises a pair of spaced rails and a carrier for said casting which is suspended below said rails; said step of positioning said casting on said casting, support comprising positioning said casting on said carrier.

12. The method of claim 11 in which spacers are provided for positioning between the end portions of said rails and said pavement base surface, and which spacers are selected and positioned as necessary to position said casting, at its proper final level when said rails supported by said pavement base layer; said rails being made of ferromagnetic material, or having ferromagnetic material located on the bottom of their end portions; said spacers being magnetic whereby they are readily positionable on and removable from said rails.

13. The method of claim 11 in which said carrier is adjustably suspended below said rails, allowing one to adjust the position of said carrier relative to the position of said rails, and wherein said carrier is adjusted to position said casting at its proper final level when said rails are supported by said pavement base layer.

14. The method of claim 11 in which the casting used is formed with an inner annular lip on the inside of the annular vertical will surrounding the casting opening said carrier being shaped such that it will pass upwardly into the opening defined by said vertical wall, but will engage and will not pass beyond annular lip, whereby said casting is supported by said carrier when said casting, support is manipulated.

15. Apparatus for use in raising manhole castings, by positioning them generally at pavement level at the top of a hole in the pavement base surface, which hole extends down to the top opening in a manhole, said apparatus comprising: a flexible corrugated sleeve for positioning over the top opening in a manhole, said sleeve being taller than the required distance between the top opening in the manhole and the level at which the casting and manhole cover are to be finally located, but being sufficiently flexible in a vertical direction that when a casting is located in the top of the sleeve, the sleeve compresses downwardly, and being sufficiently stiff in a lateral direction that it does not collapse inwardly when backfill is packed in and around the exterior of the sleeve; said sleeve including a bottom annular flange projecting outwardly from the sleeve a short distance up from the bottom end of the sleeve, defining a bottom projection which projects below said bottom annular flange; and a top annular flange projecting outwardly from the sleeve a short distance from the top of the sleeve, defining a top projection which projects above said to annular flange; said bottom projection being dimensioned to fit into said top opening in said top of said manhole, and said top projection being shaped to be inserted into said casting; and a casting support which spans said hole for the manhole casting, for positioning a casting on the top of the sleeve, and compressing the sleeve downwardly until the casting support rests on the pavement base surface.

16. The apparatus of claim 15 in which said sleeve is made of a polymeric material.

17. The apparatus of claim 15 in which said casting support comprises a pair of spaced rails and a carrier for said casting which is suspended below said rails, whereby positioning said casting on said casting support can be accomplished by positioning said casting on said carrier; said carrier being adjustably suspended below said rails, allowing one to adjust the position of said carrier relative to the position of said rails, at its proper final level when said rails are supported by said pavement base layer.

18. The apparatus of claim 17 which includes spacers for positioning between the end portions of said rails and the pavement base surface, and which spacers are selected and positioned as necessary to position said casting at its proper final level when said rails are supported by said pavement base layer; said rails being made of ferromagnetic material, or having ferromagnetic material located on the bottom of their end portions; said spacers being magnetic whereby the are readily positionable on and removable from said rails.

* * * * *